United States Patent [19]

Nakamura

[11] Patent Number: 4,874,172

[45] Date of Patent: Oct. 17, 1989

[54] REEL TAPE FIXING DEVICE AND REEL

[75] Inventor: Kikuo Nakamura, Iruma, Japan

[73] Assignee: Sigma, Incorporated, Tokyo, Japan

[21] Appl. No.: 265,714

[22] Filed: Nov. 1, 1988

[30] Foreign Application Priority Data

Nov. 13, 1987 [JP] Japan ..... 62-287927

[51] Int. Cl.[4] ..... A63F 5/04

[52] U.S. Cl. ..... 273/143 R

[58] Field of Search ..... 273/143

[56] References Cited

U.S. PATENT DOCUMENTS 4,410,178 10/1983 Partridge ..... 273/143 R

FOREIGN PATENT DOCUMENTS 115566 1/1982 Japan ..... 273/143 R
7268 1/1988 Japan ..... 273/143 R
2160345 12/1985 United Kingdom ..... 273/143 R

*Primary Examiner*—Anton O. Oechsle
*Attorney, Agent, or Firm*—Beveridge, DeGrandi & Weilacher

[57] ABSTRACT

The reel tape fixing device according to this invention comprises reel tape fixing means for securing the reel tape wound on the reel frame, slide means having a flat surface which slides on a side surface of the circular reel frame, radial means for retaining a position in the radial direction, projected from the slide means, and engaged in a groove formed in the reel frame in the circumferential direction thereof, guide means for guiding the radially positioning means into the groove, projected in parallel with the slide means from a position opposed to the radial means, and circumferential means for retaining a position in the circumferential direction in mesh with a plurality of detents formed partially on the periphery of the reel frame on the opposite side of the groove.

21 Claims, 5 Drawing Sheets

REEL TAPE FIXING DEVICE AND REEL

BACKGROUND OF THE INVENTION

1. FIELD OF THE INVENTION

This invention relates to a reel, and reel tape fixing device for securing a reel tape in the shape of a tape to a circular reel frame used in the slot machine.

2. RELATED BACKGROUND ART

In the conventional device for fixing a reel tape to a circular reel frame, as shown in FIG. 1, a double adhesive tape 2 is adhered to the entire circumference (A) of the reel frame 1,1, and a reel tape (not shown) is adhered to the double adhesive tape 2. An index 3, a reel sensor 4 and a motor (not shown) are stationary, and thus the symbols on the reel tape are not aligned with a line on a picture glass. In the case that the index 3 is displaceably disposed on the reel frame 1, the index 3 is displaced so that the reel frame 1 may be stopped at a different position, whereby a standard symbol on the reel tape, and the line on the picture glass are aligned.

This conventional device has a problem that when a reel tape which has been put to a commercial use is changed, the double adhesive tape 2 tends to stick to the reel frame 1, and it takes much time to change the reel tape with another.

Another problem is that without alignement of the symbols with the line of the picture glass, the symbols of respective reels do not align with one another due to deviations of part precisions.

Further another problem is that in the case where the index 3 is movable, when the reel is abruptly stopped, the index 3 deviates, with a result that the standard symbol on the reel tape, and the line on the picture glass come into unalignment with each other.

SUMMARY OF THE INVENTION

An object of this invention is to provide reel tape fixing device which makes it possible to change a reel tape readily and to agree easily a standard symbol on the reel tape with the line on a picture glass.

The reel tape fixing device according to this invention comprises reel tape fixing means for securing the reel tape wound on the reel frame; slide means having a flat surface which slides on a side surface of the circular reel frame; radial means for retaining a position in the radial direction, projected from the slide means, and engaged in a groove formed in the reel frame in the circumferential direction thereof; guide means for guiding the radial means into the groove, projected in parallel with the slide means from a position opposed to the radial means; and circumferential means for retaining a position in the circumferential direction in mesh with a plurality of detents formed partially on the periphery of the reel frame on the opposite side of the groove.

This invention having the above described structure enables a reel tape to be changed readily and the standard symbol on the reel tape to be easily aligned with the line on a picture glass, in cooperation of the reel tape fixing means, the slide means, the radial means, the guide means and the circumferential means.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENT

Figure 2B:
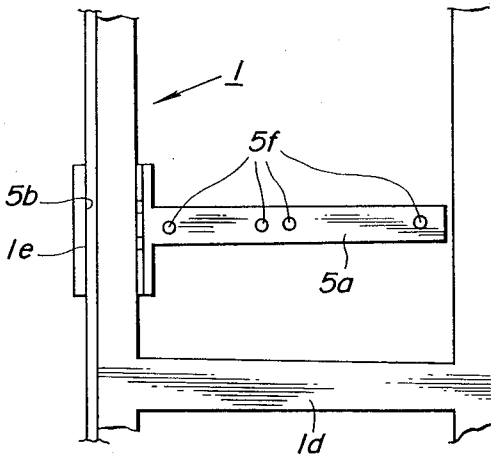
FIGS. 2A and 2B are perspective views of one embodiment of the reel tape fixing device according to this invention, together with a reel frame.
Figure 2A:
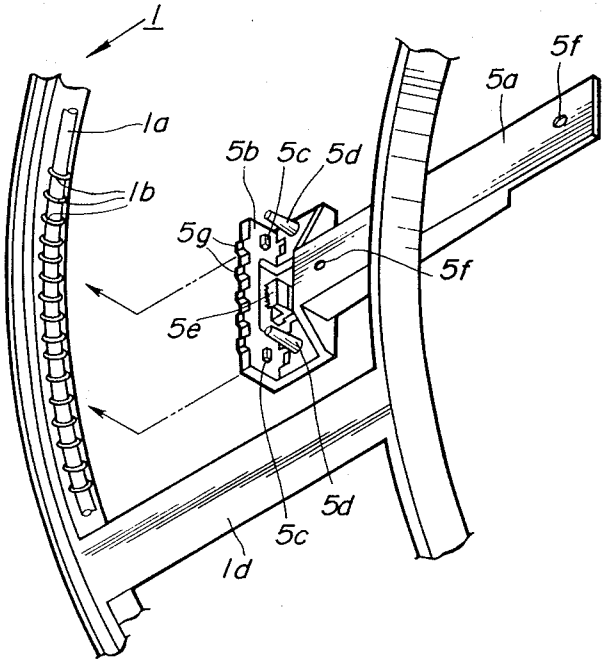

FIGS. 2A and 2B show one embodiment of the reel tape fixing device according to this invention, and a reel frame. FIG. 3 is a sectional view showing a process of the reel tape fixing device 5 being engaged in a reel frame 1. A projection 1*a* is formed circumferentially in the inner side surface of the reel frame 1. A plurality of detents 1*b* are radially formed partially on the projection 1*a*. A groove 1*c* is circumferentially formed in the outer side surface of the reel frame 1.

The reel tape fixing device 5 basically comprises a reel tape fixing means 5*a*, a slide means 5*b*, radial means 5*c*, guide means 5*d*, and circumferential means 5*e*. The reel tape fixing means 5*a* secures a reel tape (not shown) wound on the reel frame 1 and has a plurality of screw holes 5*f*, 5*f*, . . . formed in a flat surface thereof parallel with the reel tape. The screw holes 5*f*, 5*f*, . . . spaced from one another accommodate various types of reel tapes having different widths. The flat surface of the reel tape fixing device 5 is partially formed in a bracket section for reinforcement (see FIG. 2A).

Figure 1:
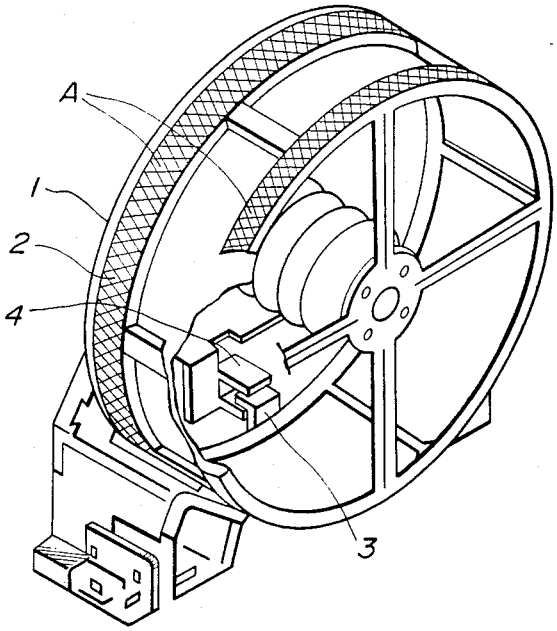
FIG. 1 PRIOR ART
FIG. 1 is a perspective view explaining the prior art of reel tape fixing device.

The slide means 5*b* is in the form of a flat member parallel with a side surface member 1*e* of the reel frame 1. The slide means 5*b* has the portion contacted with the outer edge portion (the upper portion in FIG. 1) of the reel frame 1 provided with a plurality of corrugations 5*g* so as to be caught easily by a thumb or otherwise, to move the reel tape fixing device circumferentially. The slide means 5*b* has the radial means 5*c*, 5*c* which are in the form of a rectangular parallelepipied projections engageable in the groove 1*c* in the left side surface of the reel frame 1 (as viewed in FIG. 3). In this embodiment, a rectangular parallelepiped is used as the radial means 5*c* but, needless to say, the shape of the radial means is not limited to rectangular. The radial means 5*c* may be cylindrical or conical projections as long they can fix a radial position. The shape and the pitch of the rectangular projections are determined suitably empirically or experimentally in view of a size of the groove 1*c* formed in the reel frame 1.

The guide means 5*d*, 5*d* are in the form of substantially conical projections formed parallel with the slide means 5*b* at the opposing position to the radial means 5*c*, 5*c*. The side surface member 1*e* of the reel frame 1 is inserted between the guide means 5d, 5d and the slide means 5b, and the radial means 5c, 5c are engaged in the groove 1c formed in the side surface member 1e of the reel frame 1 (see FIG. 3C). The guide means 5d, 5d are not limited to a conical projections but may be, e.g., a tapered rectangular parallelepiped or tapered elliptical cylinder. The guide means of such configuration provides an increased contact area with the projection 1a on the inner side surface of the reel frame 1, with a result of the prevention of the circumferential deviation of the reel tape fixing device 5.

The circumferential means 5e has section of inverted T shape (see FIG. 3) and comprises a clamp member 5h and pawls 5i. The clamp member 5h and the pawls 5i are formed in one piece. The gap between the pawls 5i and the slide means 5b is widened by pressing down the clamp member 5h ( see FIG. 3B). The number, pitch and shape of the pawls formed on the tip of the pawls 5i are suitably determined experimentally or empirically in view of the pitch and shape of the detents 1b of the reel frame 1. What should be noted is that the pawls 5i and the detents 1b are made circumferentially fixed in engagement with each other.

Figure 3A:
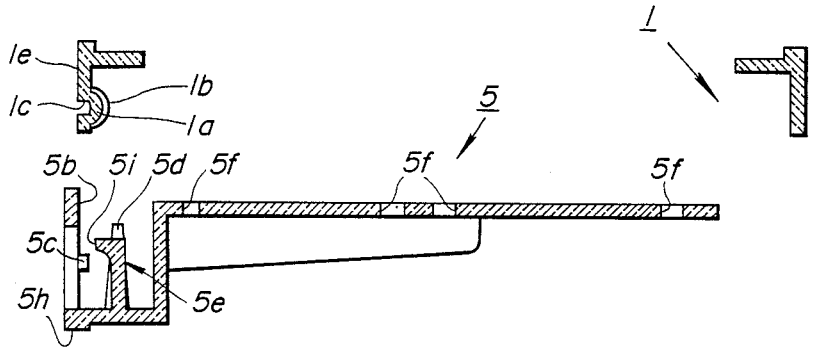
FIGS. 3A, 3B and 3C are sectional views showing the process of mounting the reel tape fixing device on the reel frame.
Figure 3B:
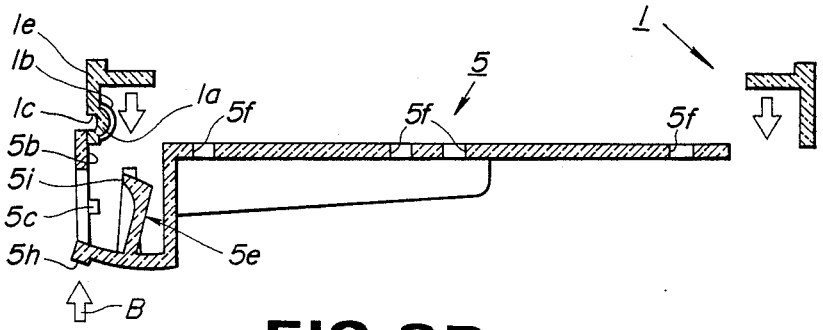
Figure 3C:
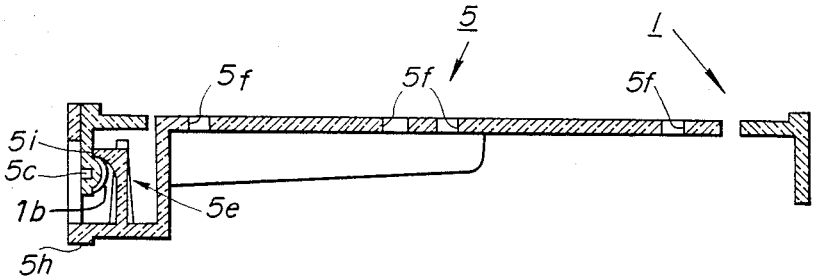
Figure 4:
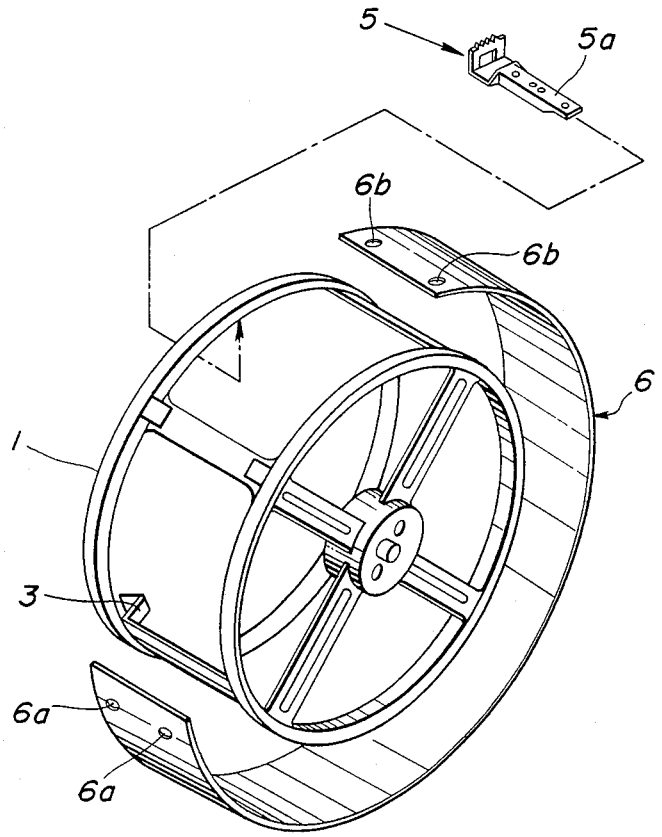
FIG. 4 is a broken perspective view explaining how to assemble the reel.

Next the function of the reel tape fixing device 5 will be explained with reference to FIGS. 3 and 4.

How to assemble the reel will be explained with reference to FIG. 4. FIG. 4 is a broken perspective view of the reel tape fixing device before being mounted to the reel frame 1. A reel tape 6 is in a rectangular shape having sides longer than the circumference of the reel frame 1. Symbols, such as patterns, figures, etc. are drawn on the front side of the reel tape 6. Two screw holes 6a are formed in one end of the reel tape 6 at the positions corresponding to the screw holes formed in the reel tape fixing means 5a. A double adhesive tape is adhered between the two screw holes 6a. Two slots 6b elongated in the longitudinal direction of the reel tape 6 are formed in the other end of the reel tape 6. The screw holes 6a, and the slots 6b are formed at the same pitch so that the screw holes 6a overlap the corresponding slots 6 when the reel tape 6 is wound on the reel frame 1.

Firstly, the reel tape fixing device 5 is mounted on the reel frame 1. How to mount the reel tape fixing device 5 on the reel frame 1 will be explained in good detail later with reference to FIG. 2. Then, one end of the reel tape 6 is secured to the screw holes 5f, 5f of the reel tape fixing means 5a with screws. Further the reel tape 6 is wound to adhere the other end thereof to the double adhesive tape applied to one end mentioned above and fastened with screws. The fastening with the screws secures the reel tape 6 to the reel frame 1.

Then, how to mount the reel tape fixing device 5 will be explained with reference to FIG. 3. Firstly, the reel tape fixing device 5 is approached to the reel frame 1 from the inside thereof so that the side surface member 1e of the reel frame 1 abuts on the slide means 5b of the reel tape fixing device 5 (FIG. 3A). Then the clamp member 5h of the circumferential means 5e is pressed in the direction of the arrow (B) to widen the gap between the pawls 5i and the slide means 5b (FIG. 3B). The clamp member 5h is returned to its original position when the radial means 5c come into engagement with the groove 1c of the reel frame 1 thereby to cause the pawls 5i into the detents 1b of the reel frame 1 (FIG. 3 C). In other words, the engagement of the radial means 5c in the groove 1c of the reel frame 1 and that of the pawls 5i in the detents 1b of the reel frame 1 secure the reel tape fixing device 5 to the reel frame 1. FIG. 2B shows the bird's eye view of FIG. 3C. As described above, the reel tape 6 is mounted in the state shown in FIG. 2B.

FIG. 5 shows modifications of a reel tape fixing device according to this invention. FIG. 5A is a side view showing the first modification of the reel tape fixing device. The difference from the embodiment described above (see FIG. 2) is that the reel tape fixing means has the central portion elevated outward. In this case, a frame member 1d provided along the circumference of the reel frame also has the central portion elevated.

Figure 5C:
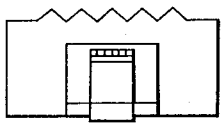
FIGS. 5A–E are views of modifications of the reel tape fixing device according to this invention.
Figure 5D:
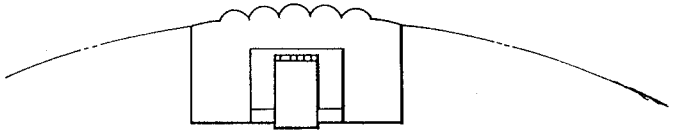
Figure 5E:
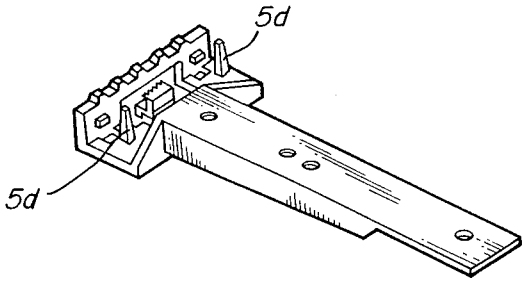
Figure 5A:
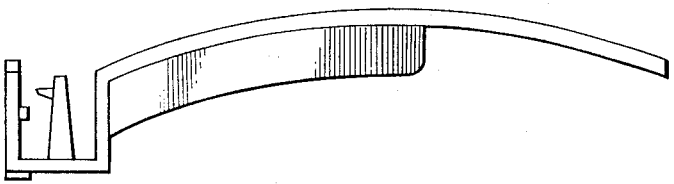
Figure 5B:
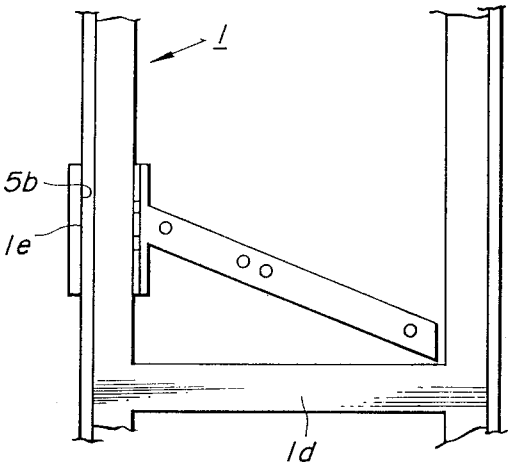

FIG. 5B is a plane view showing the second modification of the reel tape fixing device. The difference from the embodiment described above (see FIG. 2) is that the reel tape fixing means is inclined circumferentially toward the flat surface of the slide means. The area on which the reel tape is fixed, is enlarged and it results that the fixing force is increased.

FIG. 5C is a view taken along the side plane of the reel, which shows the third modification of the reel tape fixing device. The difference from the embodiment described above (see FIG. 2) is that the slide means has triangular projections provided on the top.

FIG. 5D is a view taken along the side plane of the reel, which shows the fourth modification of the reel tape fixing device. The defference from the embodiment described above (see FIG. 2) is that the slide means has corrugated projections provided on the top having substantially the same curvature as a side surface of the reel frame. Accordingly, the corrugated projections can be caught easily by a thumb or others to move the reel tape fixing device circumferentially.

FIG. 5E is a perspective view showing the fifth modification of the reel tape fixing device. The difference from the embodiment described above (see FIG. 2) is that the guide means 5d is in the form of a prism tapered toward the top. Arranging one side of the polygonal base so as to be parallel to the slide means, results that the fixing force in circumferential direction is increased due to line contact between the guide means and the elevated portion of the circular reel frame.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

I claim:

1. A reel tape fixing device comprising:

reel tape fixing means for securing a reel tape wound on a circular reel frame;

slide means having a flat surface which slides on a side surface of said circular reel frame;

radial means for retaining a position in the radial direction, projected from the slide means, and engaged in a groove formed in said reel frame in the circumferential direction thereof;

guide means for guiding said radial means into said groove, projected in parallel with said slide means from a position opposed to said radial means; and circumferential means for retaining a position in said circumferential direction in mesh with a plurality of detents formed partially on the periphery of said reel frame on the opposite side of said groove.

2. A reel tape fixing device according to claim 1, wherein said reel tape fixing means has a plurality of screw holes formed in the axial direction of the said reel frame.

3. A reel tape fixing device according to claim 1, wherein said reel tape fixing means has a reinforcing portion projected in the axial direction of said reel frame.

4. A reel tape fixing device according to claim 1, wherein said reel tape fixing means includes a flat surface orthogonal to a flat surface of said slide means.

5. A reel tape fixing device according to claim 1, wherein said reel tape fixing means has the central portion elevated outward.

6. A reel tape fixing device according to claim 1, wherein said reel tape fixing means is inclined circumferentially toward the flat surface of said slide means.

7. A reel tape fixing device according to claim 1, wherein said slide means has a corrugated projections provided on the top thereof.

8. A reel tape fixing device according to claim 1, wherein said slide means has triangular projections provided on the top thereof.

9. A reel tape fixing device according to claim 1, wherein said slide means has corrugated projections provided on the top thereof, said top having substantially the same curvature as the circumferential surface of said reel frame.

10. A reel tape fixing device according to claim 1, wherein said radial means is in the form of a rectangular parallelepiped projected member.

11. A reel tape fixing device according to claim 1, wherein said radial means is in the form of two projections provided on both sides circumferentially of said reel frame.

12. A reel tape fixing device according to claim 1, wherein said guide means is substantially in the form of a cone tapered toward the top thereof.

13. A reel tape fixing device according to claim 1, wherein said guide means is in the form of a prism tapered toward the top thereof.

14. A reel tape fixing device according to claim 1, wherein said circumferential means has inverted T shaped section.

15. A reel tape fixing device according to claim 1, wherein said circumferential means comprises pawls to mesh with said detents formed on the periphery of said reel frame, and a clamp member for widening a gap between said pawls and said slide means.

16. A reel tape fixing device according to claim 1, wherein said circumferential means has pawls whose pitch is smaller than that of said detents formed on the periphery of said reel frame.

17. A reel tape fixing device according to claim 1, wherein said guide means and said circumferential means are formed radially inside of said reel tape fixing means relative to the radius of the reel.

18. A reel tape fixing device according to claim 1, wherein said reel frame is a circular reel frame for use in the mechanically driven slot machine.

19. A reel comprising:

a circular reel frame having a groove circumferentially in the outer side surface thereof, and an elevated portion having detents formed at a certain pitch, and formed circumferentially on the opposite side of said groove;

a reel tape fixing device comprising reel tape fixing means for securing a reel tape wound on said circular reel frame, slide means having a flat surface which slides on a side surface of said circular reel frame, radial means for retaining a position in the radial direction, projected from the slide means, and engaged in said groove formed in said reel frame in the circumferential direction thereof, guide means for guiding said radial means into said groove, projected in parallel with said slide means from a position opposed to said radial means, and circumferential means for retaining a position in said circumferential direction in mesh with a plurality of detents formed partially on the periphery of said reel frame on the opposite side of said groove.

20. A device for securing a reel tape to a circular reel frame of a slot machine, comprising a support means adapted to secure end portions of the tape in overlapping relationship, and mounting means for mounting the support means to the frame, the mounting means being adapted to locate the support means radially and circumferentially with respect to the frame and to allow adjustment of the circumferential location therealong.

21. A reel frame having a reel tape secured thereto by a device as claimed in claim 20.

* * * * *